US005124619A

United States Patent [19]

Moisin et al.

[11] Patent Number: 5,124,619

[45] Date of Patent: Jun. 23, 1992

[54] CIRCUIT FOR DRIVING A GAS DISCHARGE LAMP LOAD

[75] Inventors: Mihail S. Moisin, Lake Forest; Kent E. Crouse, Wheeling, both of Ill.

[73] Assignee: Motorola, Inc., Schaumburg, Ill.

[21] Appl. No.: 705,856

[22] Filed: May 28, 1991

[51] Int. Cl.[5] ..... H05B 37/00

[52] U.S. Cl. ..... 315/219; 315/226; 315/DIG. 7

[58] Field of Search ..... 317/209 R, 209 T, 219, 317/220, 221, 224, 226, 307, 362, DIG. 7

[56] References Cited

U.S. PATENT DOCUMENTS 4,525,649 6/1985 Knoll et al. ..... 315/226 X 5,047,690 9/1991 Nilssen ..... 315/226 X

*Primary Examiner*—Robert J. Pascal

[57] ABSTRACT

A circuit (100) for driving a gas discharge lamp load (102, 104, 106) and including: an inverter (112) receiving a unidirectional voltage output and producing an alternating voltage, and having a control input (156, 166); a series-resonant oscillator (126) coupled to the inverter output (116) and having an inductance (128) and a capacitance (130) in series for producing an alternating current; an output transformer (134) coupling the lamp load to the oscillator in series with the inductance and in parallel with the capacitance; and a feedback transformer (146) having a primary winding (148) coupled in parallel with the output transformer and coupled in series with the capacitance and a secondary winding (150, 152) coupled to the control input of the inverter. Since the feedback transformer primary winding carries only capacitive current ($I_C$), the frequency of the circuit is substantially independent of the load. This allows the feedback transformer to be of the non-saturating-core type while retaining control of the oscillator frequency. Also, the circuit automatically shuts down in the event of load short-circuit.

12 Claims, 2 Drawing Sheets

CIRCUIT FOR DRIVING A GAS DISCHARGE LAMP LOAD

FIELD OF THE INVENTION

This invention relates to the driving of gas discharge lamp loads, and particularly, though not exclusively, to the driving of fluorescent lamps.

BACKGROUND OF THE INVENTION

Gas discharge lamps such as fluorescent lamps are most efficiently operated when driven with an AC voltage of high frequency, typically 30KHz. Such a drive voltage is typically generated by a resonant "tank" circuit made up of an inductive element and a capacitive element. The tank circuit is typically supplied from a utility mains (e.g. having voltage of 120VAC, 60Hz) via a rectifier and an inverter. The inverter typically includes series-connected transistors whose control electrodes are transformer-coupled to the tank circuit output so that the inverter provides to the tank circuit a supply which alternates at the frequency of the tank circuit.

In a known type of circuit for driving two or more fluorescent lamps, a series-resonant tank circuit is used. In such a resonant circuit the inductive element and the capacitive element are connected in series. Such a series-resonant circuit behaves most like a current source, i.e. at its resonant frequency it generates a signal whose current remains substantially constant, independent of the voltage supplied. To such a series-resonant circuit, a multiple fluorescent lamp load is typically connected with the lamps in series. Since a series-resonant circuit behaves most like a current source, such a series-resonant circuit is inherently self-ballasting and so does not require additional ballasting components. Such a series connection arrangement of lamps to a series-resonant circuit generates less power than older drive circuits arrangements (which employ parallel-resonant tank circuits driving parallel connected lamps), enabling lower-rated transformers and other components to be used, and wasting less energy through dissipation. Another advantage of using a series-resonant circuit to drive fluorescent lamps is that such a circuit automatically achieves a high voltage at power-on, which aids striking of the lamps.

Typically, in such a series-resonant circuit the inverter is coupled to the tank circuit output by a saturating-core transformer. The use of a saturating-core transformer enables rapid switching of the inverter transistors, allowing relatively tight control of the inverter output. However, such saturating core transformers are highly specified components which are typically expensive.

SUMMARY OF THE INVENTION

In accordance with the invention there is provided a circuit for driving a gas discharge lamp load, the circuit comprising:

inverter means having an input for receiving a unidirectional voltage and an output for producing an alternating voltage, and including at least a first control input; and series-resonant oscillator means coupled to the output of the inverter means, and including an inductance and a capacitance coupled in series for producing an alternating signal; and output means for coupling the lamp load to the oscillator in series with the inductance and in parallel with the capacitance, the improvement comprising:

transformer means having a primary winding coupled in parallel with the output means and coupled in series with the capacitance and having a secondary winding coupled to the control input of the inverter means.

In such a circuit, since the transformer means carries only the capacitive component of the total oscillator means current, the frequency of the inverter means (and hence of the circuit as a whole) is substantially independent of the load. This allows the transformer means to be of the non-saturating-core type while retaining control of the oscillator frequency. This also causes the circuit to shut down in the event of load short-circuit.

BRIEF DESCRIPTION OF THE DRAWINGS

Two circuits in accordance with the present invention for each driving loads of three fluorescent lamps will now be described, by way of example only, with reference to the accompanying drawings, in which.

DESCRIPTION OF THE PREFERRED EMBODIMENT

Figure 1:
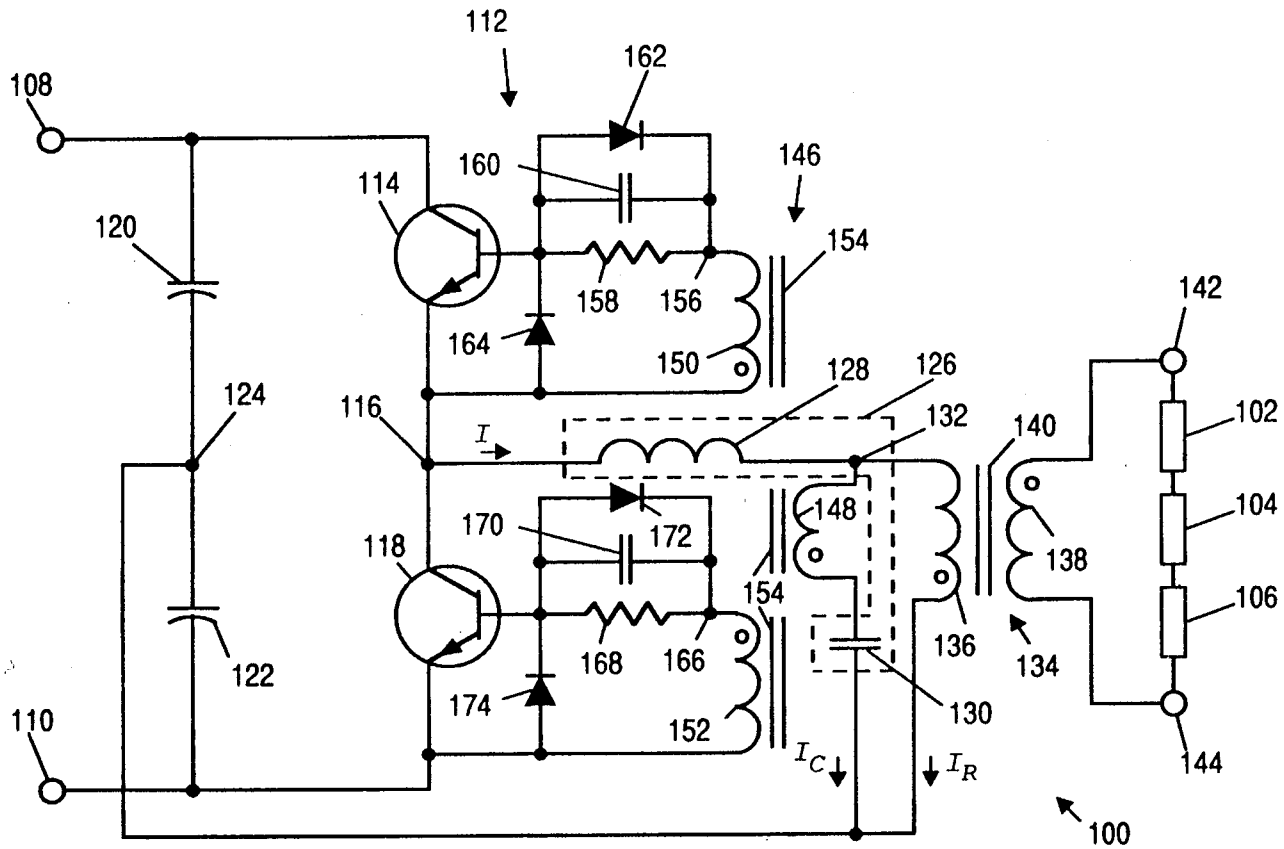
FIG. 1 shows a schematic circuit diagram of a first fluorescent lamp drive circuit.

Referring now to FIG. 1, a first circuit 100, for driving three fluorescent lamps 102, 104, 106, has two input terminals 108, 110 for receiving thereacross a DC supply voltage of approximately 390V.

A half-bridge inverter 112 has a bipolar npn transistor 114 (of the type BUL45) connected at its collector electrode to the positive input terminal 108. The transistor 114 has its emitter electrode connected to a node 116. A further npn transistor 118 (like the transistor 114, of the type BUL45) of the inverter 112 has its collector electrode connected to the node 116. The transistor 118 has its emitter electrode connected to the ground input terminal 110. Two capacitors 120, 122 (having equal values of approximately 0.47$\mu$F) are connected in series between the input terminals 108, 110 via a node 124.

A series-resonant tank circuit 126 has an inductor 128 (having a value of approximately 2mH) and a capacitor 130 (having a value of approximately 6.8nF) connected in series between the node 116 and the node 124 via a node 132.

A load-coupling transformer 134 has a primary winding 136 (having approximately 200 turns) and a secondary winding 138 (having approximately 200 turns) wound on a core 140. The primary winding 136 of the transformer 134 is connected between the node 132 and the node 124 (in series with the inductor 128 and in parallel with the capacitor 130). The secondary winding 138 of the transformer 134 is connected between output terminals 142, 144. The fluorescent lamps 102, 104, 106 are connected in series between the output terminals 142, 144.

An inverter-coupling transformer 146 has a primary winding 148 (having approximately 2 turns) and two secondary windings 150, 152 (each having approximately 20 turns) wound on a core 154. The primary winding 148 of the transformer 146 is connected in series with the capacitor 130 between the node 132 and the capacitor 130.

The secondary winding 150 is connected between a node 156 and the emitter electrode of the transistor 114. The transistor 114 has its base electrode connected to the node 156 via a current-limiting resistor 158 (having a value of approximately 20Ω). A capacitor 160 (having a value of approximately 4.7nF) is connected in parallel with the resistor 158. A diode 162 has its anode connected to the base electrode of the transistor 114 and has its cathode connected to the node 156. A further diode 164 has its anode connected to the emitter electrode of the transistor 114 and has its cathode connected to the base electrode of the transistor 114.

The secondary winding 152 is connected (with opposite polarity with respect to the secondary winding 150) between a node 166 and the emitter electrode of the transistor 118. The transistor 118 has its base electrode connected to the node 166 via a current-limiting resistor 168 (having a value of approximately 20Ω. A capacitor 170 (having a value of approximately 4.7nF) is connected in parallel with the resistor 168. A diode 172 has its anode connected to the base electrode of the transistor 118 and has its cathode connected to the node 166. A further diode 174 has its anode connected to the emitter electrode of the transistor 118 and has its cathode connected to the base electrode of the transistor 118.

In use of the driver circuit 100, the series-resonant tank circuit 126 formed by the inductor 128 and the capacitor 130 resonates at approximately its natural resonant frequency, substantially independently of variations in the load presented by the lamps 102, 104, 106, as will be explained hereafter. It will be understood that variations in the lamp load may be caused by aging of the lamps or may replacement of one more of the lamps by lamps of a different impedance. Variation of the circuit's frequency of oscillation from its optimum frequency may lower the efficiency of the circuit.

The inverter-coupling transformer 146 causes oscillation of the series-resonant tank circuit 126 to control the conduction of the transistors 114 and 118 of the inverter 112. When the current in the primary winding 148 of the transformer is in a first direction, the voltage induced in the secondary winding 150 and applied to the base of the transistor 114 causes the transistor 114 to conduct and to supply current in the first direction to the tank circuit. Conversely, when the current in the primary winding 148 of the transformer is in a second direction opposite the first direction, the voltage induced in the secondary winding 150 and applied to the base of the transistor 118 causes the transistor 118 to conduct and to supply current in the second direction to the tank circuit. Thus it will be appreciated that the tank circuit 126 and the inverter 112 are connected in a closed-loop feedback arrangement.

It will be understood that since the load presented by the lamps 102, 104, 106 is connected, via the transformer 140, in series with the inductor 128 and in parallel with the capacitor 130, the total current I developed by the tank circuit 126 and flowing through the inductor 128 is split into a load current $I_R$ flowing through the primary winding 136 of the transformer 134 and a capacitive current $I_C$ flowing in parallel through the primary winding 148 of the transformer 146 and the capacitor 130, where $$I = I_R + I_C$$

Considering the operation of the closed-loop feedback arrangement formed by the tank circuit 126 and the inverter 112, it will be appreciated that the feedback signal to the inverter is the current $I_C$ which flows through the primary winding 148 of the transformer 146. It will be appreciated that the feedback arrangement will operate at the frequency at which there is zero phase difference between the feedback signal $I_C$ and the input voltage $V_{IN}$ to the tank circuit. The input voltage $V_{IN}$ to the tank circuit is the voltage at the node 116. Thus, it will be appreciated that by simple AC circuit analysis the ratio of the feedback signal $I_C$ and the input voltage $V_{IN}$ is given by the following equation $$\frac{I_C}{V_{IN}} = \frac{j\omega RC}{R(1-\omega^2 LC) - j\omega L} \tag{1}$$

where C is the value of the resonant capacitor 130, L is the value of the resonant inductor 128, R is the value of the load impedance, ω is the frequency of oscillation of the tank circuit 126 and the inverter 112 and $j=\sqrt{-1}$.

Multiplying the numerator and denominator of equation (1) by $[R(1-\omega^2 LC)-j\omega L]$ yields the following equation $$\frac{I_C}{V_{IN}} = \frac{j\omega RC[R(1-\omega^2 LC) - j\omega L]}{[R(1-\omega^2 LC)]^2 + (\omega L)^2}$$

which reduces to $$\frac{I_C}{V_{IN}} = \frac{\omega^2 RLC + j\omega R^2 C(1-\omega^2 LC)}{[R(1-\omega^2 LC)]^2 + (\omega L)^2} \tag{2}$$

Thus it will be understood that, from the numerator of equation (2), the phase, φ, of the feedback signal $I_C$ relative to the tank circuit input voltage $V_{IN}$ is given by the following equation $$\phi = \arctan\left(\frac{\omega R^2 C(1-\omega^2 LC)}{\omega^2 RLC}\right)$$

which reduces to $$\phi = \arctan\left(\frac{R}{\omega L}(1-\omega^2 LC)\right) \tag{3}$$

Thus, as referred to above, the tank circuit 126 and the inverter 112 will oscillate at the frequency at which there is zero phase difference between the feedback signal $I_C$ and the input voltage $V_{IN}$, i.e. at which $\phi=0$. Imposing this condition on equation (3) yields the following equation $$\frac{R}{\omega L}(1-\omega^2 LC) = 0$$

which reduces to $$\omega = \sqrt{\frac{1}{LC}} \tag{4}$$

Thus, it can be seen from equation (4) that the oscillation frequency, $\omega$ of the tank circuit 126 and the inverter 112 is independent of the load impedance R.

It will therefore be appreciated that by using the tank circuit capacitive current as the feedback signal as described, the oscillation frequency of the circuit is made independent of variations in load impedance, allowing the transformer 146 to be of the non-saturating-core type which operates linearly and is less highly specified and less expensive than prior art saturating-core type transformers.

It will be appreciated that the capacitors 160 and 170 provide a small delay in the switching ON of one of the transistors 114 and 118 when the other of the transistors switches OFF, in order to prevent both of the transistors from conducting at the same time. It will be understood that the capacitors 160 and 170 provide a small phase lag in the switching of the transistors 114 and 118 respectively, which will slightly reduce the oscillation frequency of the circuit from that given by equation (4), but will still leave the circuit's oscillation frequency substantially independent of variations in the load impedance.

It will further be appreciated that in operation the circuit 100 provides a further advantage of automatically shutting down if the load is shorted. This inherent safety feature may be explained as follows. In the event of a short appearing between the output terminals 142 and 144, the load Current $I_R$ will increase sharply; simultaneously, however, the capacitive current $I_C$ will fall to a very low level. Since the feedback signal which controls the inverter 112 is taken from the tank circuit capacitive current $I_C$, the low level of this current in the event of a load short removes drive from the transistors 114 and 118 of the inverter 112 and rapidly disables the inverter and so also the tank circuit. In this way drive is rapidly removed from the output terminals in the event of their being shorted.

Figure 2:
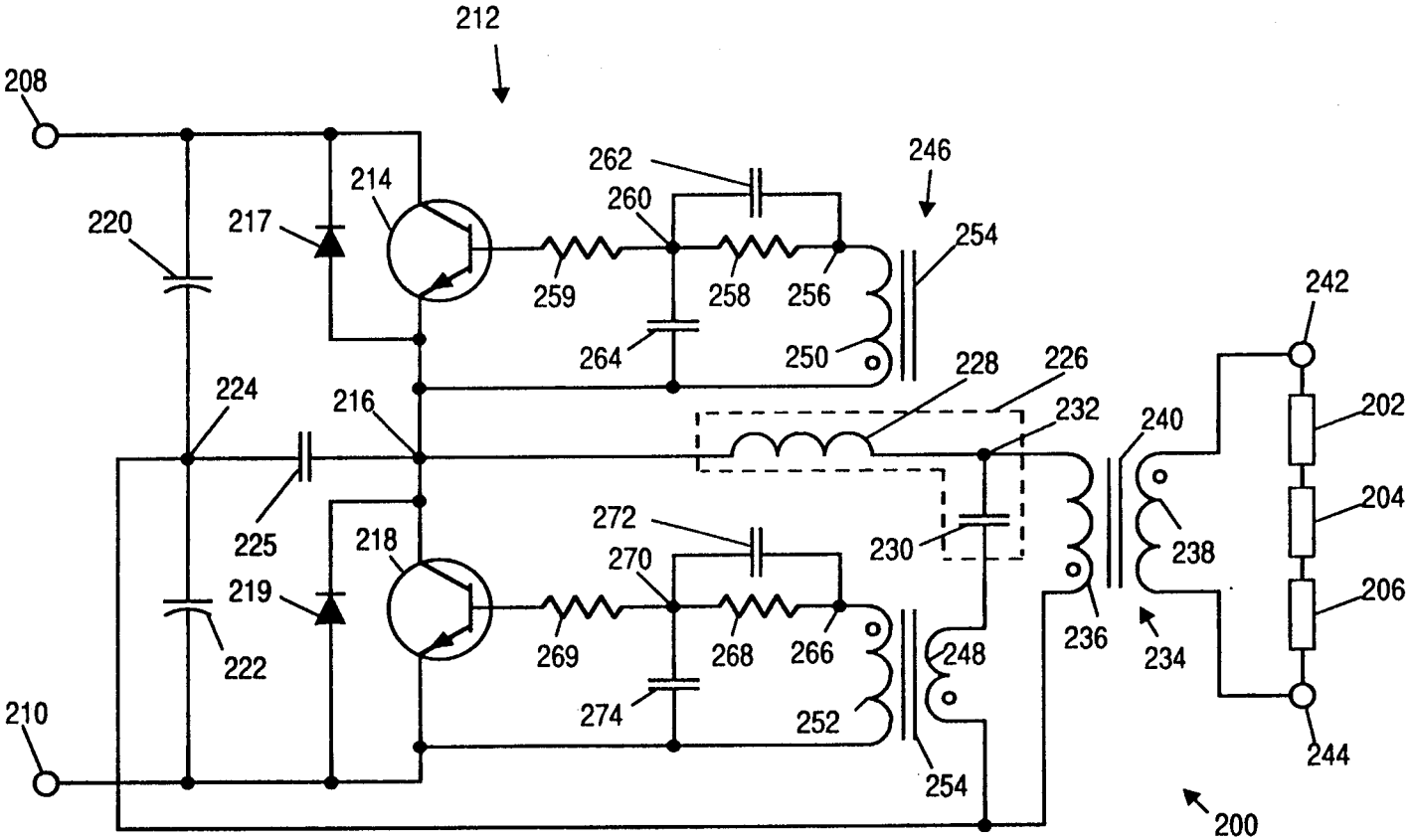
FIG. 2 shows a schematic circuit diagram of a second fluorescent lamp drive circuit.

Referring now to FIG. 2, a second circuit 200, for driving three fluorescent lamps 202, 204, 206, has two input terminals 208, 210 for receiving thereacross a DC supply voltage of approximately 460V.

A half-bridge inverter 212 has a bipolar npn transistor 214 (of the type MJE18004) connected at its collector electrode to the positive input terminal 208. The transistor 214 has its emitter electrode connected to a node 216. A diode 217 has its cathode connected to the positive input terminal 208 and has its anode connected to the node 216. A further npn transistor 218 (like the transistor 214, of the type MJE18004) of the inverter 212 has its collector electrode connected to the node 216. The transistor 218 has its emitter electrode connected to the ground input terminal 210. A diode 219 has its cathode connected to the node 216 and has its anode connected to the ground input terminal 210. Two capacitors 220, 222 (having equal values of approximately 47$\mu$F) are connected in series between the input terminals 208, 210 via a node 224. A further capacitor 225 (having a value of approximately 1200pF) is connected between the node 216 and the node 224.

A series-resonant tank circuit 226 has an inductor 228 (having a value of approximately 1.6mH) and a capacitor 230 (having a value of approximately 4.7nF) connected in series between the node 216 and the node 224 via a node 232.

A load-coupling transformer 234 has a primary winding 236 (having approximately 117 turns) and a secondary winding 238 (having approximately 170 turns) wound on a core 240. The primary winding 236 of the transformer 234 is connected between the node 232 and the node 224 (in series with the inductor 228 and in parallel with the capacitor 230). The secondary winding 238 of the transformer 234 is connected between output terminals 242, 244. The fluorescent lamps 202, 204, 206 are connected in series between the output terminals 242, 244.

An inverter-coupling transformer 246 has a primary winding 248 (having approximately 6 turns) and two secondary windings 250, 252 (each having approximately 24 turns) wound on a core 254. Each of the secondary windings 250, 252 has an inductance of approximately 80$\mu$H. The primary winding 248 of the transformer 246 is connected in series with the capacitor 230 between the node 224 and the capacitor 230.

The secondary winding 250 is connected between a node 256 and the emitter electrode of the transistor 214. The transistor 214 has its base electrode connected to the node 256 via two current-limiting resistors 258 (having a value of approximately 27$\Omega$) and 259 (having a low, near-zero value) which are connected in series via a node 260. A capacitor 262 (having a value of approximately 0.22$\mu$F) is connected in parallel with the resistor 258. A further capacitor 264 (having a value of approximately 0.1$\mu$F) is connected to the emitter electrode of the transistor 214 and to the node 260.

The secondary winding 252 is connected (with opposite polarity with respect to the secondary winding 250) between a node 266 and the emitter electrode of the transistor 218. The transistor 218 has its base electrode connected to the node 266 via two current-limiting resistors 268 (having a value of approximately 27$\Omega$) and 269 (having a low, near-zero value) which are connected in series via a node 270. A capacitor 272 (having a value of approximately 0.22$\mu$F) is connected in parallel with the resistor 168. A further capacitor 274 (having a value of approximately 0.1$\mu$F) is connected to the emitter electrode of the transistor 218 and to the node 270.

It will be appreciated that the driver circuit 200 is fundamentally the same as the already-described driver circuit 100 of FIG. 1, a feedback signal to the bases of each of the transistors 114 and 118 of the inverter being taken from the capacitive current flowing through the capacitor 230 of the series-resonant tank circuit 226. In this way the driver circuit 200, like the driver circuit 100 of FIG. 1, inherently provides the safety feature of automatically shutting down if the load is shorted. Also like the driver circuit 100 of FIG. 1, the circuit 200 resonates at a frequency which is substantially independent of variations in the load presented by the lamps 202, 204, 206. However, as will be explained below, unlike the driver circuit 100 of FIG. 1, the driver circuit 200, resonates at a frequency which is somewhat less than its natural oscillation frequency of its tank circuit.

It can be shown that for maximum power transfer to the lamps 202, 204, 206 the circuit's oscillation frequency $\omega$ is given by the following equation $$\omega = \omega_0\sqrt{\left(1 - \frac{\alpha^2}{4}\right)} \tag{5}$$

where $\omega_0$ is the tank circuit's natural oscillation frequency, $$\alpha = \frac{1}{r} \sqrt{\frac{L}{C}} .$$

and r is the reflected load in the primary winding 236 of the transformer 234. A typical value for $\alpha$ is $\sqrt{2}$, which reduces equation (5) to:

$$\omega = \frac{\omega_0}{\sqrt{2}} \quad (6)$$

Thus, from equation (6) it can be seen that for optimum power transfer, the circuit's oscillation frequency should be some 70% of the tank circuit's natural oscillation frequency. This reduction in frequency is achieved in the circuit of FIG. 2 by the components 258, 259, 262 and 264 in the base drive of the transistor 214 and the components 268, 269, 272 and 274 in the base drive of the transistor 218.

It will be understood that in each of the base drives of the transistors 214 and 218 the capacitors 262 & 264 and 272 & 274 respectively act to introduce a phase lag in the signal applied to the transistor base drive relative to the signal induced in the secondary winding 150 or 152 respectively of the transformer 146. It will be appreciated that the phase lags introduced by the capacitors 262, 264, 272 and 274 act in the same sense as the capacitors 160 and 170, already discussed above in relation to FIG. 1, to lower the oscillation frequency of the circuit from that given by equation (4). However, in the circuit of FIG. 2 the capacitors 262, 264, 272 and 274 serve to lower the oscillation frequency of the circuit to a greater extent than in the circuit of FIG. 1. In this way the oscillation frequency of the circuit of FIG. 2 is reduced to approximately 70% of the value given by equation (4). It will be understood that, even though in the circuit of FIG. 2 the oscillation frequency is reduced to a greater extent from the tank circuit's natural oscillation frequency than in the circuit of FIG. 1, the oscillation frequency of the circuit of FIG. 2 remains substantially independent of variations in the circuit's load impedance.

It will also be understood that in the circuit of FIG. 2 the capacitor 225 serves to increase the transition time between high and low states of the nominally square-wave signal produced at the inverter output between the nodes 216 and 214. This serves to reduce power dissipation in the transistors 214 and 218 near to their switching points. It will also be understood that in the circuit of FIG. 2 the diodes 217 and 219 serve to provide emitter-to-collector conduction paths around the transistors 214 and 218 respectively, which aids switching of the transistors.

It will be appreciated that other component networks could be used for the inverter transistor base drives, or other drive arrangements could be used to drive different numbers of lamps, while still providing substantial independence of circuit oscillation frequency from load variation and also providing automatic shut-down in the event of load short-circuit.

It will also be appreciated that various other modifications or alternatives to the above described embodiment will be apparent to the person skilled in the art without departing from the inventive concept of coupling a lamp load to a series-resonant oscillator in series with the resonant inductor and in parallel with resonant capacitor, and using the resonant capacitor to provide a feedback signal to control the transistors of an inverter which supplies the oscillator so as to make the circuit's oscillation frequency substantially independent of load variations.

We claim:

1. A circuit for driving a gas discharge lamp load, the circuit comprising:

inverter means having an input for receiving a unidirectional voltage and an output for producing an alternating voltage, and including at least a first control input; and series-resonant oscillator means coupled to the output of the inverter means, and including an inductance and a capacitance coupled in series for producing an alternating signal; and output means for coupling the lamp load to the oscillator in series with the inductance and in parallel with the capacitance, the improvement comprising:

transformer means having a primary winding coupled in parallel with the output means and coupled in series with the capacitance and having a secondary winding coupled to the control input of the inverter means.

2. A circuit according to claim 1 wherein the inverter means further includes a second control input and the transformer means has first and second secondary windings connected with opposite polarity respectively to the first and second control inputs, the first and second control inputs controlling the output of the inverter at high and low states respectively.

3. A circuit according to claim 2 wherein the inverter means comprises first and second switch means each having a control input connected respectively to the first and second control inputs of the inverter.

4. A circuit according to claim 3 wherein the first and second switch means comprise transistor switches.

5. A circuit according to claim 4 wherein the transistor switches comprise npn bipolar transistors.

6. A circuit according to claim 1 further comprising a capacitance connected in series between the secondary winding and the control input of the inverter.

7. A circuit according to claim 6 further comprising: a resistance connected in parallel with the capacitance, a first diode connected in parallel with the capacitance and the resistance, and a second diode connected in parallel with the secondary winding.

8. A circuit according to claim 6 further comprising: a resistance connected in parallel with the capacitance, and a further capacitance connected in parallel with the secondary winding.

9. A circuit according to claim 1 further comprising a capacitance connected in parallel with the inverter output.

10. A circuit according to claim 3 further comprising a first diode coupled in parallel with the first switch means and second diode coupled in parallel with the second switch means.

11. A circuit according to claim 1 wherein the output means comprises a transformer.

12. A circuit for driving a gas discharge lamp load, the circuit comprising:

inverter means having an input for receiving a unidirectional voltage and an output for producing an alternating voltage, and including first switch means having a first control input and second switch means having a second control input; and series-resonant oscillator means coupled to the output of the inverter means, and including an inductance and a capacitance coupled in series for producing an alternating signal; and output means for coupling the lamp load to the oscillator in series with the inductance and in parallel with the capacitance, the improvement comprising:

transformer means having a primary winding coupled in parallel with the output means and coupled in series with the capacitance and having a first and secondary windings coupled with opposite polarity respectively to the first and second control inputs of the inverter means; and capacitance means coupled in series between the first and secondary windings and the first and second control inputs of the inverter means.

* * * * *